United States Patent [19]

Uchiyama et al.

[11] Patent Number: 4,943,823

[45] Date of Patent: Jul. 24, 1990

[54] STRUCTURE OF WASHING CONVEYANCE ROLLER FOR PHOTOSENSITIVE MATERIAL PROCESSING MACHINE

[75] Inventors: Kaoru Uchiyama; Tetuya Ishizuka, both of Tokyo, Japan

[73] Assignee: Fuji Photo Film Co., Ltd., Kanagawa, Japan

[21] Appl. No.: 230,948

[22] Filed: Aug. 11, 1988

[30] Foreign Application Priority Data

Aug. 26, 1987 [JP] Japan ..... 62-212292

[51] Int. Cl.[5] ..... G03D 3/02; G03D 3/08

[52] U.S. Cl. ..... 354/322; 354/325

[58] Field of Search ..... 354/298, 319, 320, 321, 354/322, 324, 325

[56] References Cited

U.S. PATENT DOCUMENTS

| | | | |
|---|---|---|---|
| 4,034,389 | 7/1977 | Huss | 354/322 |
| 4,123,769 | 10/1978 | Fernandez et al. | 354/325 |
| 4,806,962 | 2/1989 | Uchida et al. | 354/321 |
| 4,839,683 | 6/1989 | Kushima et al. | 354/322 |

*Primary Examiner*—A. A. Matthews

*Attorney, Agent, or Firm*—Sughrue, Mion, Zinn, Macpeak & Seas

[57] ABSTRACT

A photosensitive material to which an image has been exposed is successively dipped into treatment liquid such as developer wherein development or other treatment is conducted. The photosensitive material drawn out from each treatment liquid is held by holding rollers and the treatment liquid is wiped off. Since washing water is supplied to these holding rollers to wash and wipe off the treatment liquid from the photosensitive material and the water is supplied to the treatment chambers, the holding rollers can be kept clean.

20 Claims, 2 Drawing Sheets

STRUCTURE OF WASHING CONVEYANCE ROLLER FOR PHOTOSENSITIVE MATERIAL PROCESSING MACHINE

BACKGROUND OF THE INVENTION

1. Field of the Invention

This invention relates to a structure for washing conveyance rollers of a photosensitive material treatment machine for use in silver salt photographic type of copying machines and the like.

2. Description of the Related Art

A silver salt photographic type copying machine copies original images onto photosensitive materials, and has the advantage that high quality copies can be produced as compared with the electric photographic type of copying machines.

A copying machine of the type described above in general produces a copy by transporting a photosensitive material from a magazine thereof to an exposure portion where an original image is exposed. Next, the photosensitive material which has been exposed is transported to a treatment portion where it is developed. A developing chamber, a bleaching/fixing chamber and a water washing chamber are respectively provided in this treatment portion to which treatment liquids corresponding to the above described treatments are supplied.

For example, the developing chamber is preferably constructed so that the holding and conveying roller wipes off the developer which has been carried out by the photosensitive material and is then returned to the developing chamber. As a result, the amount of developer which is carried out at the time when the photosensitive material moves from the developing chamber to the bleaching/fixing chamber can be reduced so that the contamination of the bleaching/fixing chamber can be prevented.

However, since the developer which has been wiped off can adhere to the holding and conveying rollers provided at the entrance of the developing chamber, if the amount of developer is large, the developer cannot be sufficiently wiped off from the photosensitive material and contamination may occur.

It is therefore an object of the present invention to provide a structure for washing conveyance rollers in which treatment liquid which has been carried out from treatment chambers, for example a developing chamber, a fixing chamber or a rinsing chamber, is washed out.

SUMMARY AND OPERATION OF THE INVENTION

This invention is applied to a photosensitive material treatment machine in which the photosensitive material which has been exposed is developed in treatment chambers. The invention is characterized in that water which has been used to wash the conveyance rollers at the outlet portion of the treatment chamber is supplied to the developing chamber so as to supplement the amount of the treatment liquid which becomes depleted due to evaporation.

Therefore, according to the present invention, the treatment liquid which is carried out by the photosensitive material is thoroughly wiped off by the conveyance rollers, and these conveyance rollers are washed with water supplied for washing the rollers. This ensures that contamination of the conveyance rollers can be prevented.

PREFERRED EMBODIMENT OF THE INVENTION

Figure 1:
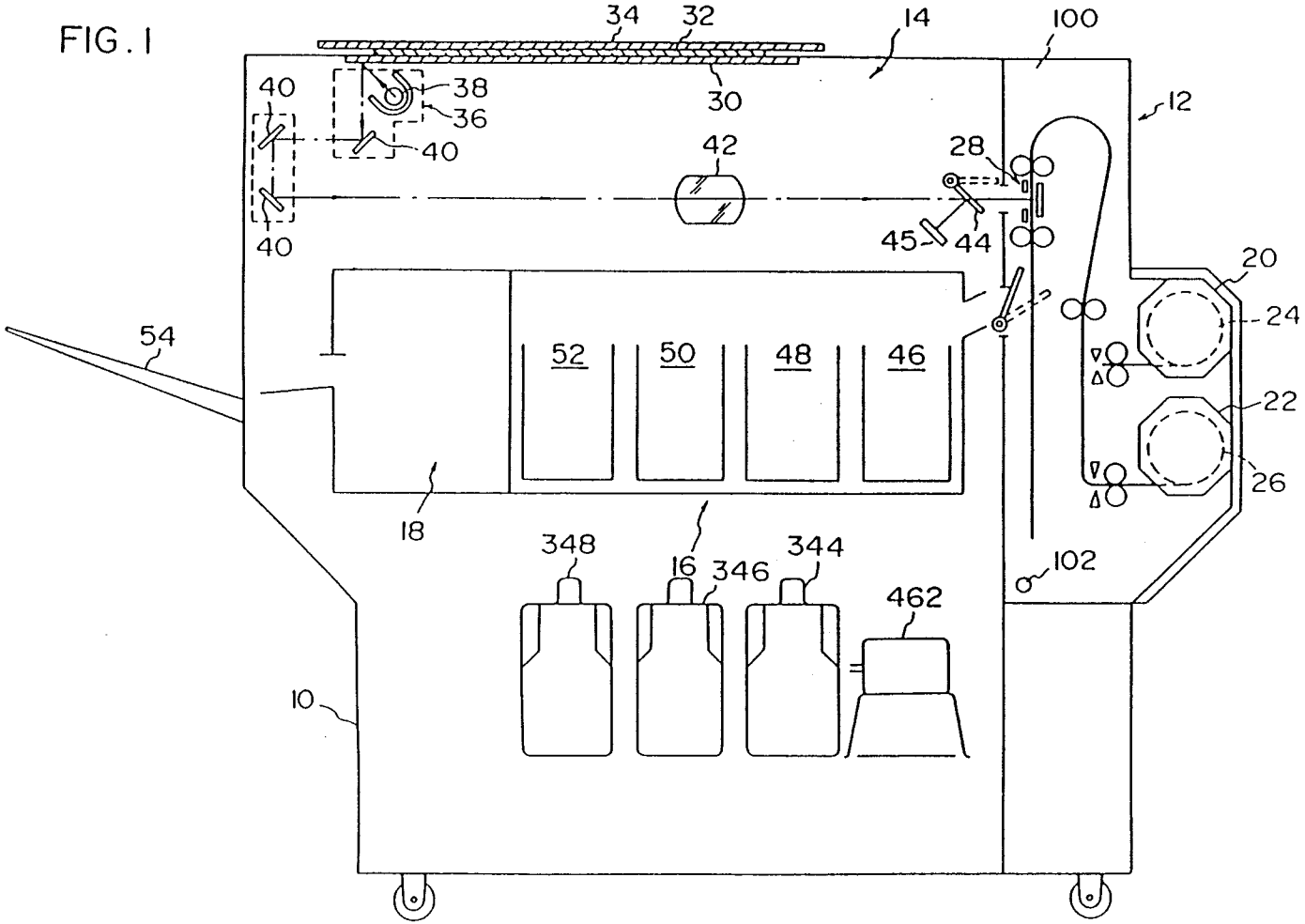
FIG. 1 is a vertical sectional view showing a copying machine to which are embodiment of the present invention is applied.

FIG. 1 shows a silver salt photography type of color copying machine to which the present invention is applied. The main device body 10 is provided with a paper supplying portion 12 on the right side, an exposure portion 14 and a treatment portion 16 in the upper portion, and a drying portion 18 on the left side. This color copying machine of a silver salt photography type is arranged in such a manner that a pair of magazines 20 and 22 can be vertically mounted on it. Photosensitive materials 24 and 26 are accommodated in the form of a roll in this copying machine of a silver salt photography type, and are arranged to be drawn out to the paper-supplying portion 12 starting from the front end of the photosensitive materials 24 and 26 in the form of a roll. For example, reference numeral 24 represents a photosensitive material which is suitable for use in copying a color photograph original, and reference numeral represents a photosensitive material which is suitable for use in copying a color print original.

The photosensitive material 24 or the photosensitive material 26 which has been drawn from the magazines 20 and is transported to an exposing aperture 28 via the paper supplying portion 12. As a result, an image of a color original 32 placed on a transparent original-holder 30 disposed above the exposing portion 14 is arranged to be exposed. This color original 32 is pressed to the original holder 30 by an original retainer 34, and is illuminated by a light source 38 disposed in a light-source unit 36. The image of the color original 32 reflected by a plurality of mirrors 40 is exposed to the photosensitive material 24 (26) placed in the exposing aperture 28 via an optical means 42 by opening a shutter 44.

When the shutter is in a closed state, the image of the color original 32 is reflected by the shutter 44, and is input to an image sensor 45 so that exposure modification conditions are determined.

A developing chamber 46, bleaching/fixing chamber 48, and water washing chambers 50 and 52 are sequentially provided in the treatment portion 16. The photosensitive material 24 (26) which has been developed, bleached, fixed and water washed by the treatment liquid enclosed in the above described chambers 46, 48, 50 and 52 is conveyed to the drying portion 18.

In the drying portion 18, the photosensitive material 24 (26) which has been washed with water is dried, and is conveyed onto a taking tray 54.

The treatment portion 16 will be described in detail.

Figure 2:
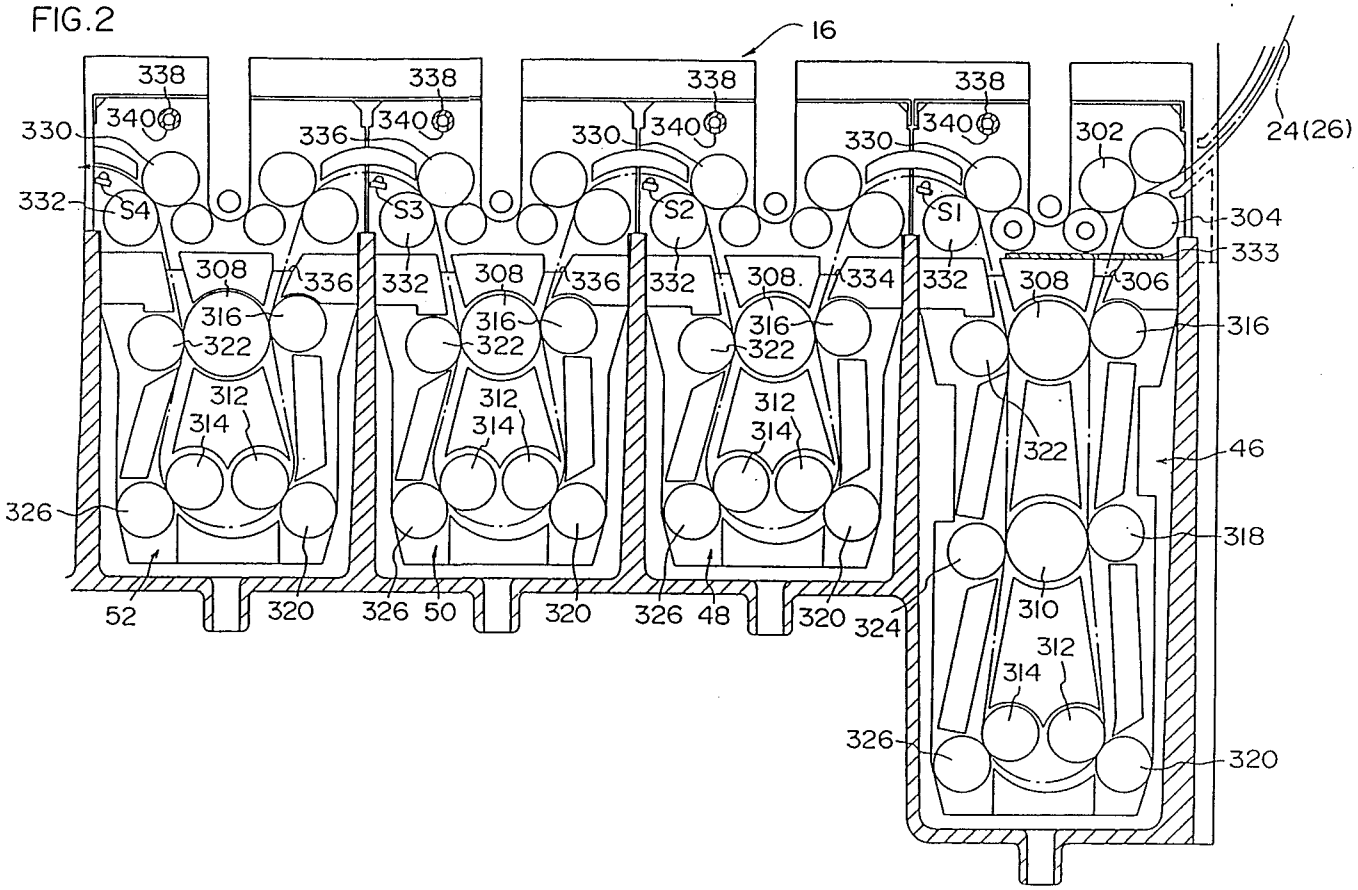
FIG. 2 is an enlarged view showing each treatment chamber in a treatment portion.

The entrance portion of the developing chamber 46 is, as shown in FIG. 2, provided with a pair of holding and conveyance rollers 302 and 304 so that the photosensitive material 24 (26) which has been exposed is conveyed into a developer 306 enclosed in the developing chamber 46.

This developing chamber 46 includes a conveyance roller 308 disposed adjacent to the liquid level of the developer 306. In addition, a conveyance roller 310 is disposed at the intermediate portion in the vertical direction, and conveyance rollers 312 and 314 are disposed adjacent to the bottom each of the above rollers 308, 310, 312 and 314 being journalled horizontally. The conveyance rollers 308, 310 and 312 are abutted by the corresponding conveyance rollers 316, 318 and 320. As a result, the photosensitive material 24 (26) which has been conveyed through between the holding and conveyance rollers 302 and 304 is dipped into the developer 306.

The conveyance rollers 308, 310, 314 are respectively abutted by the conveyance rollers 322, 324 and 326 so that the photosensitive material 24 (26) is drawn out from the developer 306 and is conveyed between the holding and conveyance rollers 330 and 332 disposed at the outlet portion. These holding and conveyance rollers 330 and 332 act to convey the photosensitive material 24 (26) which has been drawn out of the developing chamber 46 to the bleaching/fixing chamber 48.

A shutter 333 is disposed adjacent to the level of the developer enclosed in the developing chamber 46 so that the surface of the developer is covered for the purpose of preventing evaporation of the developer in a case where the photosensitive material 24 (26) does not pass.

Although the inner structures of the the bleaching-/fixing chamber 48 and the water washing chambers 50 and 52 are the same as those of the developing chamber 46, the conveyance rollers 310, 318 and 324 disposed in the intermediate portion in the vertical direction of the developing chamber 46 are omitted so that the height of the bleaching/fixing chamber 48 and water washing chambers 50 and 52 are shortened.

These conveyance rollers are respectively applied with a rotational force from a motor (omitted from illustration) in the direction through which the photosensitive material 24 (26) is conveyed.

The bleaching/fixing chamber 48 is filled with bleaching and fixing liquid 334, while the water washing chambers 50 and 52 are filled with washing water 336.

The treatment chambers have corresponding washing water supplying pipes 338 above the holding and conveyance rollers 330 so that the washing water supplying pipes 338 are disposed in parallel with each other. Each of these washing water supplying pipes 338 has an opening 340 so that washing water is supplied to the portion above the holding and conveyance roller 330. As a result of this supply, the holding and conveyance rollers 330 and 332 are washed. Therefore, the holding and conveyance rollers 330 and 332 to which the treatment liquid carried out by the photosensitive material 24 (26) is adhered can be washed out with this washing water. Furthermore, the photosensitive material 24 (26) which is being drawn out is held by these holding and conveyance roller 330 and 332. Therefore, the treatment liquid taken out from each of the treatment chambers is forcedly wiped off from the photosensitive material 24 (26).

If the washing water from the washing water supplying pipe 338 is supplied during the rotation of the holding and conveyance roller 330 and 332, an excellent washing effect can be obtained even if the quantity of the water is small. However, it is arranged not to be supplied during the passing of the photosensitive material 24 (26) for the purpose of preventing non-uniform treatment results. Therefore, it is preferable that the washing water be supplied during the rotation of the holding and conveyance rollers 330 and 332 after the final part of the photosensitive material 24 (26) has been passed. Therefore, sensors S1 to S4 for detecting the passing of the photosensitive material 24 (26) are each disposed at the outlet portion of the treatment chambers.

Washing water supplied to the holding and conveyance rollers 330 and 332 is then dropped into each of the processing chambers. Washing water dropped in the water washing chambers 50 and 52 is mixed with the washing water 336 enclosed in the treatment chambers. On the other hand, washing water dropped into the developer 306 and the bleaching and fixing liquid 334 enclosed in the developing chamber 46 and the bleaching/fixing chamber 48 supplements the amount of the treatment liquid which becomes depleted due to evaporation.

As shown in FIG. 1, a supplying bottle 344 which corresponds to the developing chamber 46, a supplying bottle 346 which corresponds to the bleaching/fixing chamber 48, and a supplying bottle 348 which corresponds to the water washing chambers 50 and 52 are respectively disposed below the treatment portion 16.

The liquid enclosed in these supplying bottles is sent by a circulating pump 462 to the corresponding chambers. However, a part of the washing water enclosed in the supplying bottle 348 is supplied to the water washing supplying pipe 338 disposed above each of the processing chambers.

An operation of this embodiment will be described.

The photosensitive material 24 (26) drawn out from the magazine 20 or the magazine 22 of the paper supplying portion 12 is transported to the exposure aperture 28. In this exposure aperture 28, the image of the color original 32 placed on the original holder 30 is slit-exposed to the photosensitive material 24 (26) by the light source unit 36. The photosensitive material 24 (26) which has been exposed is conveyed to the treatment portion 16 wherein development treatment is conducted during the passing of the photosensitive material 24 (26) through the developing chamber 46, the bleaching/fixing chamber 48 and the water washing chamber 50 and 52. After photosensitive material 24 (26) has been dried off, it is drawn out onto the taking tray 54.

The holding and conveyance rollers 330 and 332 wipe off the treatment liquid adhered to the photosensitive material 24 (26) and return it to the treatment chambers at the outlet portion of each of the treatment chambers through which the photosensitive material 24 (26) passes. Therefore, the treatment liquid adheres to the holding and conveyance rollers 330 and 332. However, since the washing water is supplied from the supplying bottle 348 to the washing water supplying pipe 338 disposed above the holding and conveyance roller 330, the treatment liquid adhered to the holding and conveyance rollers 330 and 332 can be washed down with the thus-supplied washing water. The washing water is supplied to each of the treatment chambers with this treatment liquid. By arranging the quantity of the washing water to be the amount of the treatment liquid in each of the treatment chambers which becomes depleted due to evaporation, the density of the treatment liquid in the treatment chambers can be maintained at a constant level.

The treatment liquid enclosed in the supplying bottles will be described with reference to that in the supplying bottle 346. The requisite quantity of this treatment liquid is supplied to the bleaching/fixing-chamber 48 by a supplementing pump 462. Waste liquid overflowed the bleaching/fixing chamber is returned to a bag disposed in the supplying bottle 346 for enclosing the treatment liquid.

What is claimed is:

1. A photosensitive material treatment device for developing an exposed photosensitive material comprising:

(a) treatment chambers each filled with a treatment liquid for treating a photosensitive material;

(b) means for holding and conveying said photosensitive material in said treatment chambers;

(c) means for wiping said treatment liquid remaining on said photosensitive material which has been drawn out from said treatment liquid after said treating in each of said treatment chambers each time said photosensitive material is treated in said treatment chambers; and (d) means for supplying washing water to said wiping means after each time said photosensitive material has been drawn out from said treatment chambers, and for washing water to said means, and for subsequently providing said washing water to said treatment chambers after washing said photosensitive material, whereby said wiping means is maintained clean, said treatment liquid is prevented from being carried to an ensuing process, and a constant level of said treatment liquid in said treatment chambers is maintained.

2. A photosensitive material treatment device according to claim 1, wherein said wiping means comprises a pair of holding rollers disposed at outlet portions of said treatment chambers.

3. A photosensitive material treatment device according to claim 2, wherein said pair of holding rollers are disposed in such a manner that one of said pair is disposed higher than the other one and said washing water is arranged to be supplied to said higher roller.

4. A photosensitive material treatment device according to claim 2, wherein said washing water supplying means comprises pipes disposed above said holding rollers for supplying said washing water to said rollers through openings formed in said pipes.

5. A photosensitive material treatment device according to claim 2, wherein said pair of rollers of said wiping means are rotated by driving means, and said washing water is arranged to be supplied while driving said rollers.

6. A photosensitive material treatment device according to claim 1, wherein said washing water supplying means is operated after said photosensitive material has been drawn out from said treatment chambers.

7. A photosensitive material treatment device according to claim 1, wherein said washing water to be supplied supplements said treatment liquid in said treatment chambers by an amount of evaporation to thereby make them equal.

8. A photosensitive material treatment device for developing an exposed photosensitive material comprising:

(a) treatment chambers each filled with a treatment liquid for treating a photosensitive material;

(b) means for holding and conveying said photosensitive material in said treatment chambers;

(c) means for wiping said treatment liquid remaining on said photosensitive material which has been drawn out from said treatment liquid after said treating; and (d) means for supplying washing water to said wiping means, and for washing said wiping means, and for subsequently providing said washing water to said treatment chambers after washing said photosensitive material, whereby said wiping means is maintained clean and said treatment liquid is prevented from being carried to an ensuing process, and wherein said washing water supplying means is operated after said photosensitive material has been drawn out from said treatment chambers, said photosensitive material treatment device further comprising sensors for detecting when said photosensitive material has been drawn out from said treatment chambers.

9. A photosensitive material treatment device for use in photosensitive material is treated in treatment chambers after said photosensitive material has been exposed, and water is supplied by washing water supplying means to a pair of conveyance rollers disposed at outlet portions of said treatment chambers to wash said conveyance rollers in each of said treatment chambers each time said photosensitive material has been drawn out of said treatment chambers, and said water after washing said conveyance rollers is supplied to said treating chambers compensating an amount of said treatment liquids reduced due to evaporation.

10. A photosensitive material treatment device according to claim 9, wherein said conveyance rollers are disposed in such a manner that one of said rollers is disposed higher than the other one and washing water is supplied to said higher roller.

11. A photosensitive material treatment device according to claim 10, wherein said washing water supplying means comprises pipes disposed above said conveyance rollers to supply said washing water to said rollers through openings formed in said pipes.

12. A photosensitive material treatment device according to claim 9, wherein said conveyance rollers are rotated by driving means and said washing water is supplied during rotation of said conveyance.

13. A photosensitive material treatment device according to claim 9, wherein said washing water is supplied by a pump which supplies said washing water after said photosensitive material has been drawn out from said treatment chambers.

14. A photosensitive material treatment device according to claim 9, wherein said washing water to be supplied supplements said treatment liquid in said treatment chambers by an amount of evaporation to thereby make them equal.

15. A photosensitive material treatment device for using in photosensitive material treatment machines, wherein a photosensitive material is treated in treatment chambers after said photosensitive material has been exposed, and water is supplied by washing water supplying means to a pair of conveyance rollers disposed at outlet portions of said treatment chambers to wash said conveyance rollers, and said water after washing said conveyance rollers is supplied to said treating chambers compensating an amount of said treatment liquids reduced due to evaporation, and wherein said washing water is supplied by a pump which supplies said washing water after said photosensitive material has been drawn out from said treatment chambers, said photosensitive material treatment device further comprising sensors for detecting a fact that said photosensitive material has been drawn out from said treatment chambers.

16. A photosensitive material treatment device for treating a photosensitive material which has been exposed comprising:

(a) treatment chambers filled with treatment liquids;

(b) means for conveying a photosensitive material, said conveying means being disposed in said treatment liquid filled in said treatment chambers;

(c) a pair of holding rollers disposed at outlet portions of each of said treatment chambers for holding said photosensitive material which has been drawn out from said treatment liquid, and for wiping said treatment liquid from said photosensitive material each time said photosensitive material is treated in each of said treatment chambers; and (d) means for supplying washing water to said holding rollers so as to wash said holding rollers each time said photosensitive material is treated in said treatment chambers and after said photosensitive material has been drawn out of said treatment chambers, and supplying said washing water to said treatment chambers after said rollers have been washed.

17. A photosensitive material treatment device according to claim 16, wherein said holding rollers are disposed in such a manner that one of said holding rollers is disposed higher than the other one and washing water is supplied to said higher roller.

18. A photosensitive material treatment device according to claim 16, wherein said washing water supplying means comprises pipes disposed above said holding rollers so that washing water is supplied to said rollers through openings formed in said pipes.

19. A photosensitive material treatment device according to claim 16, wherein said holding rollers are rotated by driving means and said washing water is supplied during rotation of said holding rollers.

20. A photosensitive material treatment device according to claim 16, wherein said washing water supplying means includes a passage and is operated after said photosensitive material has been drawn out from said treatment chambers.

* * * * *